United States Patent [19]

Perrella

[11] Patent Number: 4,840,013

[45] Date of Patent: Jun. 20, 1989

[54] MACHINE AND PROCESS FOR SINUOUSLY FOLDING A BATT OF NON-WOVEN FIBROUS MATERIAL

[75] Inventor: Guido Perrella, West Mount, Canada

[73] Assignee: Graham Fiber Glass Limited, Erin, Canada

[21] Appl. No.: 181,679

[22] Filed: Apr. 15, 1988

[30] Foreign Application Priority Data

Feb. 29, 1988 [CA] Canada ..... 560127

[51] Int. Cl.[4] ..... B65B 63/02; B65H 45/00

[52] U.S. Cl. ..... 53/429; 53/117; 53/439; 53/530; 493/451

[58] Field of Search ..... 53/429, 439, 530, 529, 53/120, 117, 116; 493/448, 451

[56] References Cited

U.S. PATENT DOCUMENTS

| | | | |
|---|---|---|---|
| 1,710,979 | 4/1929 | Herbener . | |
| 1,760,419 | 5/1930 | Lehmann . | |
| 2,898,594 | 8/1959 | Levinstein | 493/448 X |
| 3,290,704 | 12/1966 | Willis | 5/337 |
| 3,448,557 | 6/1969 | Swaithes | 53/117 |
| 3,465,492 | 9/1969 | Jensen | 493/451 X |
| 3,513,628 | 5/1970 | Lee et al. | 53/124 |
| 3,837,138 | 9/1974 | Terry | 53/439 |
| 3,919,827 | 11/1975 | Larson et al. | 53/429 |
| 4,062,169 | 12/1977 | Lister et al. | 53/439 |
| 4,218,962 | 8/1980 | Cunningham et al. | 53/117 X |
| 4,603,533 | 8/1986 | Musick | 53/117 |

FOREIGN PATENT DOCUMENTS

| | | | |
|---|---|---|---|
| 348851 | 3/1935 | Canada . | |
| 387170 | 3/1940 | Canada . | |
| 492584 | 5/1953 | Canada . | |
| 671799 | 10/1963 | Canada . | |
| 712899 | 7/1965 | Canada . | |
| 817637 | 7/1969 | Canada . | |
| 892432 | 2/1972 | Canada | 493/451 |
| 894081 | 2/1972 | Canada . | |
| 1136589 | 11/1982 | Canada . | |
| 1173071 | 8/1984 | Canada . | |

*Primary Examiner*—James F. Coan

*Attorney, Agent, or Firm*—Beveridge, DeGrandi & Weilacher

[57] ABSTRACT

A machine and process is provided for sinuously folding a batt of bulky non-woven fibrous material such as glass fiber and inserting the folded batt into a container such as a bag. The machine has a support table having first and second sections separated by an intermediate section, and the intermediate section has a first series of stationary, transversely extending rotatable rollers arranged along it, and a second series of movable, transversely extending rotatable rollers supported by vertically movable mountings which allow the movable rollers to be moved from an initial raised position, in which they are raised above and separated by a gap from the stationary rollers, to a lowered position in which they are below the stationary rollers so that the stationary and movable rollers are over-lapped. Means are provided for pulling the batt along the support table when the movable rollers are in the raised position, so that the batt extends between the stationary and movable rollers and along the first and second sections of the support table, and means are provided for sequentially lowering the movable rollers starting with those closest to the center of the batt so as to form the batt into sinuous curves. A copaction chamber is provided alongside the intermediate section and a plate is provided for pushing the folded batt into the compaction chamber. The compaction chamber has a spout onto which a bag can be fitted, and has a piston movable to compact and push the folded batt through the spout and into the bag.

11 Claims, 5 Drawing Sheets

MACHINE AND PROCESS FOR SINUOUSLY FOLDING A BATT OF NON-WOVEN FIBROUS MATERIAL

The present invention provides a machine and process for packaging batts of bulky non-woven fibrous material, especially glass fiber insulation, into a container such as a plastic bag.

Glass fiber insulation is usually sold in large packages suitable for use by builders. It has also been sold in small packages for "Do It Yourself" projects. The small packages generally contain one batt of insulation of about 3½ inch (8.9 cm) thickness and 15" (38 cm) width wound into a coil and compressed within a cylindrical plastic bag. Such packages are inconvienient for persons wishing to use only a few feet of the batt at a time, since in order to unwind the batt the whole coil has to be removed from the bag and it can only be replaced with difficulty.

The present invention provides apparatus and method which allows a batt of glass fiber insulation, typically 20 feet (6.1 meters) in length and having other dimensions mentioned above, to be packaged in a sinuously folded manner inside a plastic bag or like container, such that a small quantity at a time can be pulled from a slit in the container, and unused material remains stored in the container.

In accordance with one aspect of the invention, a machine for sinuously folding a batt of bulky non-woven fibrous material and inserting the folded material into a container comprises a series of stationary, parallel, curved folding surfaces arranged as a straight row, and a series of movable, curved folding surfaces each carried by a movable mounting which allows movement of each of the latter surfaces from an initial position in which the two series of folding surfaces face each other with a gap therebetween, to a position in which each of the movable folding surfaces has passed between adjacent stationary folding surfaces so that the two types of folding surfaces are overlapped. Means are provided for moving the movable mountings in sequence such that a batt can be pulled between the two rows of folding surfaces when the movable surfaces are in their initial positions, and can be sinuously folded by sequenced movement of the movable folding surfaces from the initial to the final positions. A compaction chamber is provided alongside the two series of folding surfaces, and a plate is provided for pushing the folded batt from the folding surfaces into the compaction chamber. The compaction chamber has a spout at one end and has a movable wall or piston at the other end to compact and push the sinuously folded and compacted batt through the spout and into a container held against the spout.

Preferably, each of the movable folding surfaces, and all except a central one of the stationary folding surfaces, are constituted by rotatable rollers.

According to another aspect of the invention, a process for sinuously folding a batt of bulky non-woven fibrous material and inserting the folded batt into a container comprises the steps of:

extending the batt along a supporting surface having first and second sections separated by an intermediate section which intermediate section has a series of transversely extending stationary folding surfaces arranged therealong;

clamping said batt in the central region of said intermediate section;

progressively folding the batt into sinuous form by means of movable folding surfaces which are moved downwardly between adjacent stationary surfaces from a position initially above the batt to a position below the stationary folding surfaces, said movable folding surfaces being moved sequentially starting with those nearest the clamped part of the batt;

laterally pushing the sinuously folded batt off the folding surfaces and into a compaction chamber; and applying a force to one end of a sinuously folded batt in said chamber to compact the batt longitudinally and push it into a container held against the compaction chamber.

The invention also provides a package comprising a plastic bag having therein a longitudinally extending, sinuously folded batt of glass fiber insulation material, produced by the process described.

The invention will be further described with reference to the accompanying drawings which show a preferred embodiment, and in which.

Figure 2:
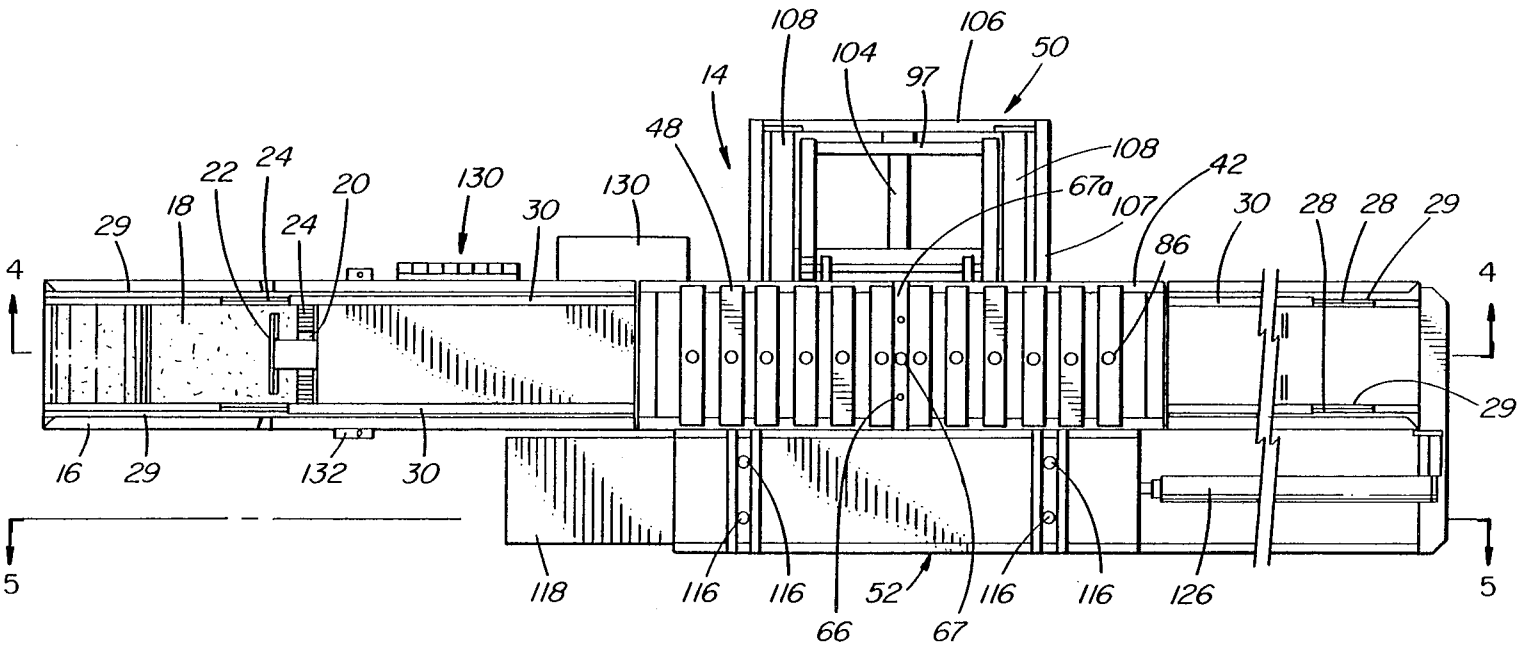
FIG. 2 is a plan view of the machine, with the parts in the same condition as in FIG. 1.
Figure 3:
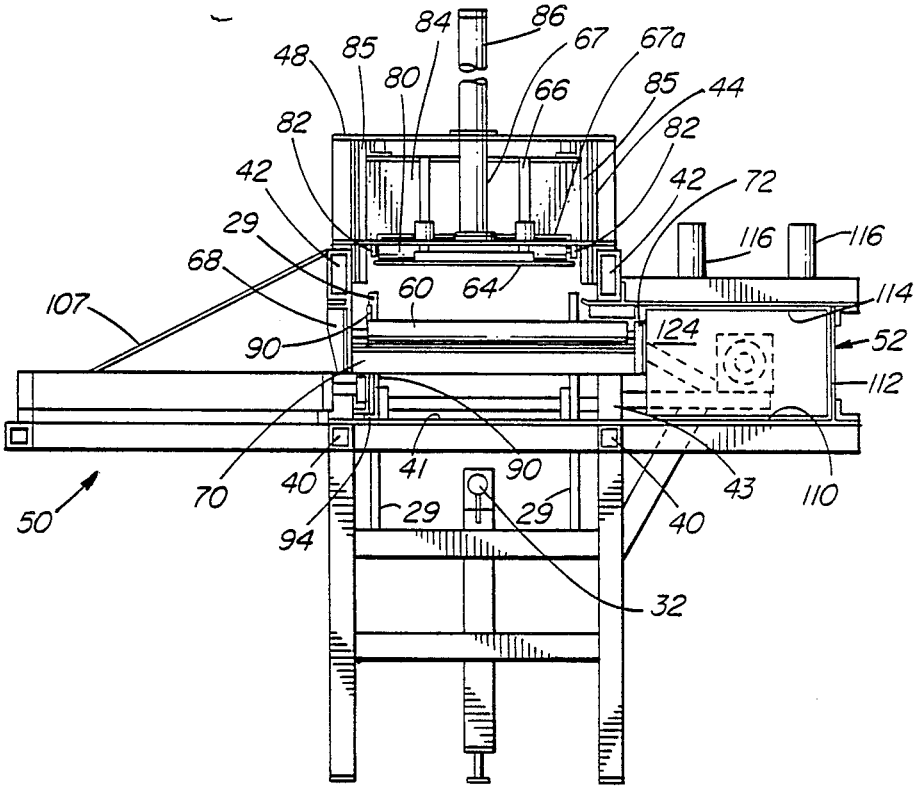
FIG. 3 is a cross-section on lines 3—3 of FIG. 1.
Figure 5:
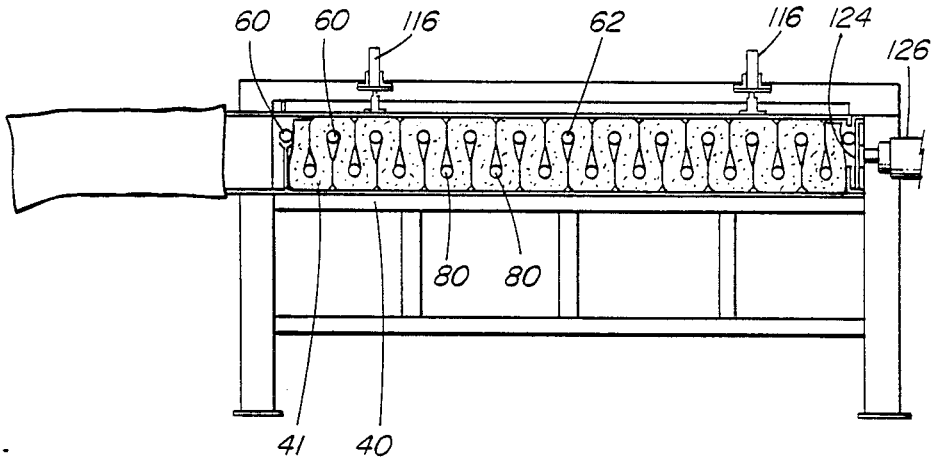
Figure 6:
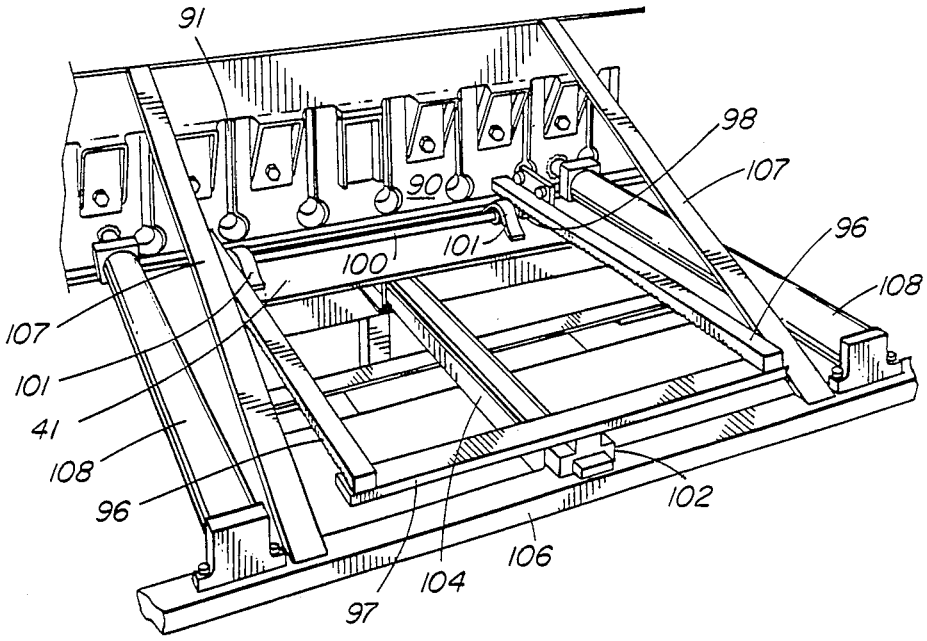
Figure 7:
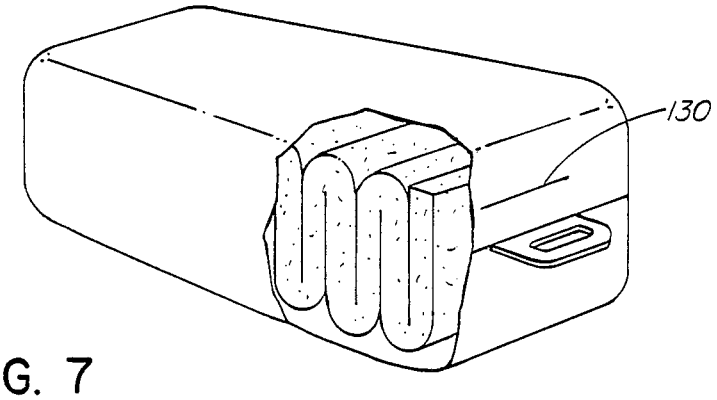

FIG. 5, which appears on the same drawing sheet as FIG. 3, is a longitudinal section on lines 5—5 of FIG. 2, showing the parts in a position in which the batt is being vertically compressed in the compaction chamber;

FIG. 6 is a perspective view of the mounting arrangement for the pusher plate; and FIG. 7 show a partially sectioned view of the package produced by the machine.

Referring to the drawings, the machine has a support table divided into three parts, namely a left hand feeding frame 10 and a right hand feeding frame 12 separated by an intermediate section 14.

Figure 1:
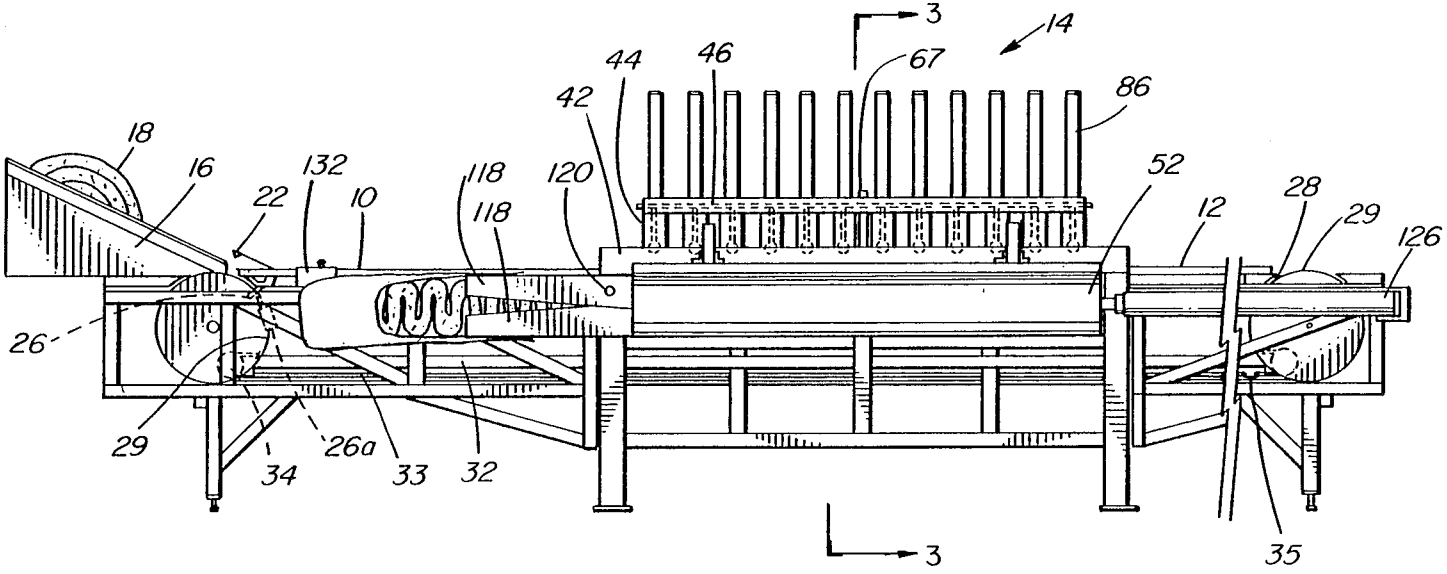
FIG. 1 shows a side elevation of the preferred form of machine, showing a batt being packaged by the machine and with parts in the position ready for accepting a further batt to be folded and packaged.

The left hand feeding frame includes a trough 16 for supporting a batt 18 of glass fiber material in loose roll form. A puller mechanism for extending the batt along the support table shown in FIG. 2 includes a movable slide part 20 having a clamping device 22 with spring means 24 by which it may be clamped onto the end of batt 18. Clamping device 22 includes a lower leg (not shown) which can be raised by a lever 26 actuated by pneumatic cylinder 26*a* indicated in FIG. 1 so as to hold open the clamp 22 while the end of the batt is fed into the clamp in the initial position shown in FIG. 1. A fixed cam (not shown) raises the lower leg to re-open the clamp when the batt has been pulled out along the support table and when the clamp has reached the position shown in FIG. 4. The clamping device is movable along the length of the support table by cables 28 which are connected to the ends of part 20 and which pass around pulleys 29 at opposite ends of the machine, the cables being recessed within angle members 30 provided at the sides of the frames 10 and 12. The lower reaches of the cables extend under the operative parts of the machine and are movable by a long pneumatic cylinder 32 located under the central axis of the machine. This cylinder is a so called rodless or cable cylinder in which a piston, moveable along a pneumatic cylinder, has its ends connected to cables which replace the usual piston rod; such cylinders are available under the tradenames ASCO "Power Beam" and Wainbee "Cable-Trol". the cylinder cables 33 pass around small pulleys 34, one of which is shown in FIG. 1, and the cables 33 are connected together by a cross member 35 which is also connected to the lower reaches of the cables 28. A single operation of this long cylinder is sufficient to move the clamping device 22 from the FIG. 2 to the FIG. 4 position and to extend an 18 foot long batt along the length of the support table.

The intermediate section 14 has the operative parts for folding and compacting the batt. This section has a base frame with side members 40 at each side of a flat bed 41, above which is an upper frame formed with side members 42 supported by vertical members 43, and which in turn carries a box-like super-structure formed of vertical plate members 44 carrying upper horizontal corner members 46 which in turn carry horizontal top plates 48. A rear side of the intermediate section has means indicated at 50 for supporting a pusher plate, described below, and a front side of the section is provided with a compaction chamber indicated at 52, also described in more detail below.

The base frame supports a row of stationary, transversely extending rotatable rollers 60. These rollers are equally spaced, at a spacing several times greater than their diameter, except at the centre where in place of a rotatable roller a fixed cylindrical folding surface 62, having diameter similar to that of the rollers, is provided. FIG. 3 is a sectional view which illustrates the stationary rollers 60; the folding surface 62 is hidden behind roller 60, but this view does show the clamping bar 64 which co-operates with member 62 to clamp the centre of the batt. Bar 64 is located by slide rods 66 and is movable under the control of pneumatic cylinder 67, which is mounted on horizontal plate 67*a* extending across the tops of side members 42.

Each stationary roller 60, and member 62, has one end supported at the rear side of the machine by a hanger bracket 68, these brackets having their upper ends fixed to the rear side frame member 42, and these brackets also provided cantilever support for one end of shallow supporting plate 70 which extends underneath the associated stationary roller. The other ends of the stationary rollers 60 are supported adjacent the compaction chamber 52 by brackets 72 carried by the supporting plates 70; accordingly all the stationary roller and supporting structure is carried in cantilever fashion from hanger brackets 68.

A series of movable, rotatable rollers 80 is provided. Referring to FIG. 3, it will be seen that the movable rollers (behind clamp bar 64 in this view) are each carried by hanger bracket 82 extending down from the lower corners of roller supports plate 84, the side edges of which slide in guideways 85 provided inside the vertical plate members 44. Each roller support plate 84 has its upper edge connected to the piston rod of a pneumatic cylinder 86 mounted on a top plate 48. Each of the movable rollers is located centrally above one of the gaps between pairs of the fixed rollers 60 and between such rollers and the central cylindrical folding surface 62. The pneumatic cylinder arrangement is such that each movable roller can be moved from the raised position shown in FIG. 3, in which the movable rollers are spaced above the stationary rollers with a gap therebetween, to a lowered position in which each movable roller has passed between stationary rollers so that the stationary and movable rollers are overlapped. Typically, the gap between the sets of rollers when the movable rollers are raised is about 4" (10 cm), and the amount of overlap when the movable rollers are lowered is about the same. The relative positions of the fixed and movable rollers, with the movable rollers lowered, are shown in FIG. 4.

Figure 4:
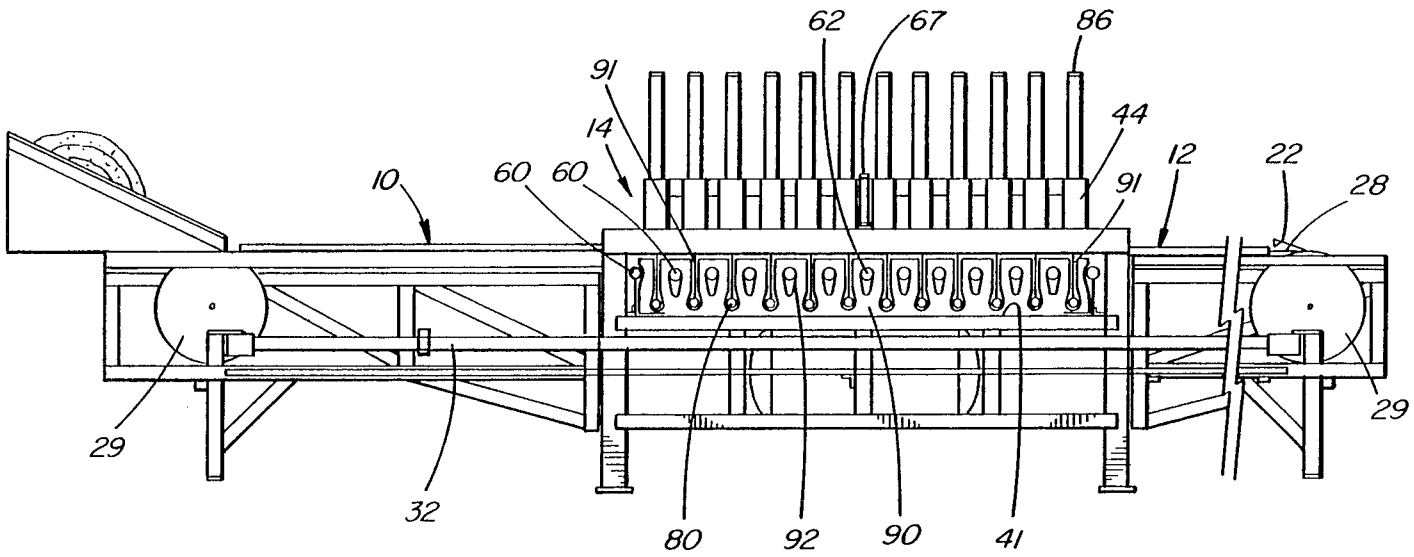
FIG. 4 is a longitudinal section on lines 4—4 of FIG. 2, but with the parts in a subsequent position in which the batt is being folded.

The pusher plate which pushes the folded batt off the rollers and into the compaction chamber is shown at 90 in FIG. 4, and the means for moving this plate rectilinearly are shown in FIG. 6. As shown in FIG. 4, the plate 90 is in the form of an elongated rectangular plate having a series of vertical slots 91 communicating with its upper edge, each slot having an enlarged lower end, these slots being arranged to accommodate the movable rollers 80 and their support plates 84 when these are in the lowered position as shown in FIG. 4. Between these slots, the pusher plate has apertures 92 with rounded upper ends and lower extensions which apertures allow the plate to slide over the stationary rollers 60 and their supporting plates 70. The pusher plate has bearing pads 94 shown in FIG. 3 which rest on the flat bed 41, and means shown in FIG. 6 allow the plate to be moved from a first position just inside the hanger brackets 68 to a second position just beyond the ends of stationary rollers 60.

FIG. 6 shows the moving and guiding means for the pusher plate. This includes a movable frame work comprising two rearwardly extending members 96 having front ends fixed to plate 90 and rear ends connected by a cross member 97. Each member 96 is in the form of a rack with teeth on its underside, and these teeth engage gear wheels 98 fixed to opposite ends of a shaft 100 which is held by bearing blocks 101 mounted on the rear of flat bed 41. The rear end of this frame work is guided by a sliding block 102 fixed centrally to the cross piece 97 and which slides on rearwardly extending guide member 104. This guide member 104 is held by a rear frame member 106 braced by stays 107. This guide arrangement, combined with the racks and the gears, ensures rectilinear motion of the plate 90. The plate 90 is moved between its two extreme positions by two pneumatic cylinders 108 having rear ends fixed to frame member 106 and having piston rods connected to the pusher plate at each side of the centre thereof.

The pusher plate is operative to move the sinuously folded batt into the compaction chamber 52. This chamber, which is generally coextensive with the intermediate section 14, has a flat bottom surface 110 coplanar with bed 41 (as shown in FIG. 3), a flat fixed outer side wall 112, a flat top wall 114 vertically movable by four pneumatic cylinders 116; the side adjacent the intermediate section 14 being open. The left hand end of the compaction chamber has an outlet spout comprising two interfitting channel members 118 with overlapping wall portions, the lower member being fixed and horizontal and the upper member being hinged to the lower member at 120. In the at rest position these channel members define a converging discharge outlet, over the end of which may be placed a flexible plastic bag as shown in FIG. 1. The right hand end of the compaction chamber is closed by a movable wall in the form of a rectangular piston 124 which can be moved the length of the chamber and a considerable part of the length of the spout by pneumatic cylinder 126 which is mounted beside the right hand feeding frame.

Automatic controls for sequencing the various pneumatic cylinders are attached to the rear side of the left hand frame. These are connected to a control box indicated at 132 in FIG. 2. This control box is situated so that an operator can stand in front of the left hand feeding frame in position to operate this control, as well as being positioned for inserting the end of the loose coil into the clamp device 22, and for placing a bag over the spout formed by members 118.

In operation, the operator places a bag over the spout which extends about one half of the length of the bag. He then operates the control box 132 to extend the pneumatic cylinder 26*a* which opens the clamp 22 at the left hand end of the machine, and he then inserts the loose end of the batt into the clamp and releases the pressure of cylinder 26*a* to allow the spring clamp to hold the end of the batt. The following operations are then performed in sequence:

Operation of cylinder 32 to move the cables 28 and hence the clamping device 22 from the left hand to the right hand of the machine, to extend the batt along the length of whole machine; the cam means described opens the clamp when this reaches the right end of the machine;

Operation of cylinder 67 to cause the clamping member 64 to clamp the centre of the batt against folding surface 62;

Operation of air cylinders 86 in pairs with each pair being centered on clamp member 64, starting with the pair closest to this clamp member, so that the movable rollers are lowered from their raised positions to the lowered positions shown in FIG. 4; operation in sequence in this way puts minimal tensile stress on the batt which is rather weak and might rupture if all of the movable rollers were moved in unison;

Operation of cylinder 67 to lift the clamp member 64;

Operation of pneumatic cylinders 108 to cause the pusher plate 90 to push the folded batt into the compaction chamber;

Actuation of cylinders 116 to lower the top wall 114 of the compaction chamber about 2 inches; and Operation of cylinder 126 to cause the rectangular piston 124 of the compaction chamber to push the folded batt from the compaction chamber and into the bag which is held over the spout members 118, simultaneously compacting the batt to about $\frac{1}{3}$ of the length of the compaction chamber.

In this last movement, the piston 124 moves through the major part of the length of the spout members 118, and during this movement the operator holds the bag in position on the spout, but allows it to be pushed off by the pressure of the batt being compacted into it.

Finally, the machine parts are returned to starting condition, and the open end of the bag is sealed by a separate heat sealing machine.

The final product is shown in FIG. 7. As shown, the batt is in compacted, sinuous form. The bag has a guide line 130 near the top of the bag where the customer is invited to make a slit, and the batt can then be withdrawn length wise through this slit. When the required amount has been withdrawn, a cut off end portion can easily be pushed back into the slit so that the remainder of the batt is tidily stored.

I claim:

1. A machine for sinuously folding a batt of bulky non-woven fibrous material and inserting the folded material into a container, comprising:

a series of stationary, parallel, curved folding surfaces arranged as a straight row;

a series of movable curved folding surfaces each carried by a movable mounting which allows movement of each of the latter surfaces from an initial position in which the two series of facing folding surfaces have a gap therebetween, to a final position in which each of the movable folding surfaces has passed between stationary folding surfaces so that the two types of folding surfaces are overlapped;

means for moving the movable mountings in sequence such that a batt can be pulled between the two rows of folding surfaces when the movable surfaces are in their initial position, and can be sinuously folded by sequenced movement of the movable folding surfaces from the initial to the final position;

a compaction chamber alongside the two series of folding surfaces; and a plate provided for pushing the folded batt from the folded surfaces into the compaction chamber;

the compaction chamber having a spout at one end and a movable wall at the other end to compact the batt longitudinally and push the sinuously folded and compacted batt through the spout and into a container held against the spout.

2. A machine according to claim 1, wherein each of the movable folding surfaces, and all of the stationary folding surfaces except a central folding surface, are constituted by rotatable rollers.

3. A machine according to claim 2, wherein clamping means is provided for clamping a central part of the batt against said central stationary folding surface.

4. A machine according to claim 2, wherein the said movable mountings are arranged to move the associated rollers in pairs with each pair being centered on said central stationary folding surface, said pairs being moved sequentially starting with rollers closest to said central surface.

5. A machine according to claim 1, wherein the compaction chamber has a top wall movable by pneumatic cylinder means to provide vertical compaction of the sinuously folded batt before the batt is compacted longitudinally.

6. A machine for sinuously folding a batt of bulky non-woven fibrous material and inserting the folded material into a container, comprising:

a support table having first and second sections separated by an intermediate section;

a first series of stationary, transversely extending rotatable rollers arranged along said intermediate section;

a second series of movable, transversely extending rotatable rollers supported by vertically movable mountings which allow the movable rollers to be moved from an initial raised position, in which the movable rollers are above the stationary rollers with a gap between the stationary and movable rollers, to a lowered, position in which the movable rollers are below the stationary rollers;

means for pulling a batt along the support table when said movable rollers are in the raised position, so that the batt overlaps with the first and second sections and extends between the rollers of the first and second series;

means for sequentially moving the movable mountings, starting with those closest to the centre of the batt, from their raised to their lowered positions, so that the batt become sinuously folded about the stationary and movable rollers;

a compaction chamber alongside the two series of folding surfaces; and a plate provided for pushing the folded batt from the folded surfaces into the compaction chamber;

the compaction chamber having a spout at one end and a movable wall at the other end to compact the batt longitudinally and push the sinuously folded and compacted batt through the spout and into a container held against the spout.

7. A machine according to claim 6, wherein said movable mountings include plates co-planar with the axis of the respective roller, each plate being connected to a pneumatic cylinder for moving the roller between the raised and lowered positions.

8. A machine according to claim 6, wherein the compaction chamber has a top wall movable by pneumatic cylinder means to provide vertical compaction of the sinuously folded batt before the batt is compacted longitudinally.

9. A process for sinuously folding a batt of bulky non-woven fibrous material and inserting the folded batt into a container comprises the steps of:

extending the batt along a supporting surface having first and second sections separated by an intermediate section which intermediate section has a series of transversely extending stationary folding surfaces arranged therealong;

clamping said batt in a central region of said intermediate section;

progressively folding the batt into sinuous form by means of movable folding surfaces which are moved downwardly between adjacent stationary surfaces from a position initially above the batt to a position below the stationary folding surfaces, said movable folding surfaces being moved sequentially starting with those nearest the clamped region of the batt;

laterally pushing the sinuously folded batt off the folding surfaces and into a compaction chamber; and applying a force to one end of the sinuously folded batt in said chamber to compact the batt longitudinally and push it into a container held against the compaction chamber.

10. A process according to claim 9, wherein the sinuously folded batt is subjected to vertical compression in the compaction chamber before said force is applied to said one end.

11. A package comprising an elongated bag containing a sinuously folded and compacted batt of glass fibre, produced according to the process of claim 9, the axis of the folds extending longitudinally of the bag.

* * * * *